United States Patent [19]

Armstrong

[11] Patent Number: 4,593,769

[45] Date of Patent: Jun. 10, 1986

[54] ROTARY ROCK DRILLING CHUCK

[75] Inventor: Charles J. Armstrong, Randburg, South Africa

[73] Assignee: Boart International Limited, Transvaal, South Africa

[21] Appl. No.: 641,377

[22] Filed: Aug. 16, 1984

[30] Foreign Application Priority Data

Aug. 16, 1983 [ZA] South Africa ..... 83/6017

[51] Int. Cl.[4] ..... E21C 5/00

[52] U.S. Cl. ..... 173/145; 279/4

[58] Field of Search ..... 173/145, 146, 141; 279/4; 408/6; 91/5; 60/414

[56] References Cited

U.S. PATENT DOCUMENTS

| | | | |
|---|---|---|---|
| 1,180,355 | 4/1916 | White | 279/4 |
| 3,885,635 | 5/1975 | Menzel | 173/146 |
| 4,097,177 | 6/1978 | Close | 173/145 X |
| 4,398,326 | 8/1983 | Joerger | 279/4 X |
| 4,475,318 | 10/1984 | Russ | 279/12 X |

*Primary Examiner*—James M. Meister
*Assistant Examiner*—John L. Knoble
*Attorney, Agent, or Firm*—Scully, Scott, Murphy & Presser

[57] ABSTRACT

A chuck for a drilling machine is fitted to a retractable spindle 21. Plungers 25 carried by a yoke 26 move when the yoke 26 abuts the front end 20 of the machine. This charges an accumulator carried inside the chuck body. Opening a valve 39 causes the chuck jaws to clamp while closing the valve 39 and opening a valve 55 causes the chuck jaws to relax.

8 Claims, 7 Drawing Figures

ROTARY ROCK DRILLING CHUCK

BACKGROUND TO THE INVENTION

This invention relates to a chuck for a rotary rock drilling machine and in particular for a diamond drilling machine.

Some rotary diamond drilling machines are thrusted by means of a feed screw. The feed screw carries a chuck which locks on to the drill rods. Conventionally such chucks are opened and closed by means of manually turned dog screws. Thus much time is wasted when a new drill rod has to be fitted at the end of the stroke of the feed screw.

It is an object of the invention to provide a chuck which does not rely on dog screws and which operates more or less automatically at least in the preferred embodiments.

SUMMARY OF THE INVENTION

For use on a rotary drilling machine, having a front end and a feed screw which moves in and out of the front end to perform a backward and a forward stroke so that a drill rod may be thrusted on the forward stroke, the invention provides a chuck adapted to be carried by the feed screw and having jaws which close and open to clamp and release drill rods, with the improvement that the jaws are hydraulically moved to their clamping position and held in that position under hydraulic pressure, and that the hydraulic pressure is generated in an accumulator circuit charged on retraction of the feed screw.

Thus the chuck may be fitted with a spring pressed plunger in a cylinder the plunger being actuated by contact between the chuck and the front end of the drilling machine, the chuck body also accommodating an accumulator and a sump space.

DESCRIPTION OF EMBODIMENTS

Figure 1:
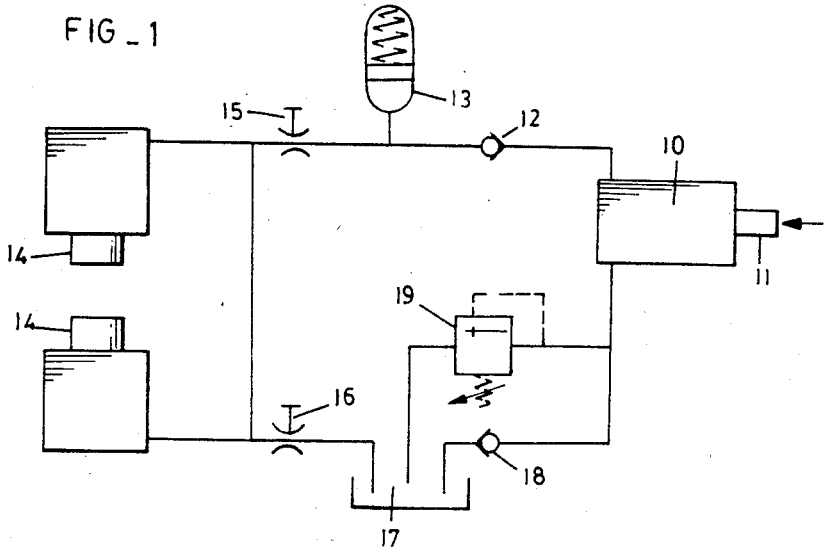
FIG. 1 is a circuit diagram of a hydraulic circuit according to the invention.
Figure 2:
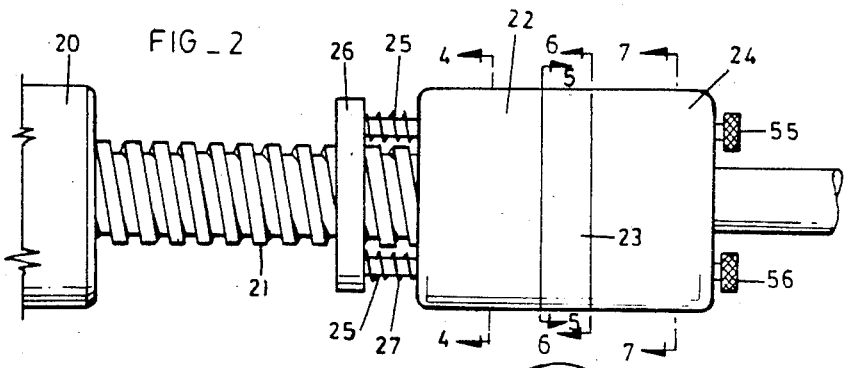
FIG. 2 is a side view of a portion of the front end of a drilling machine.
Figure 3:
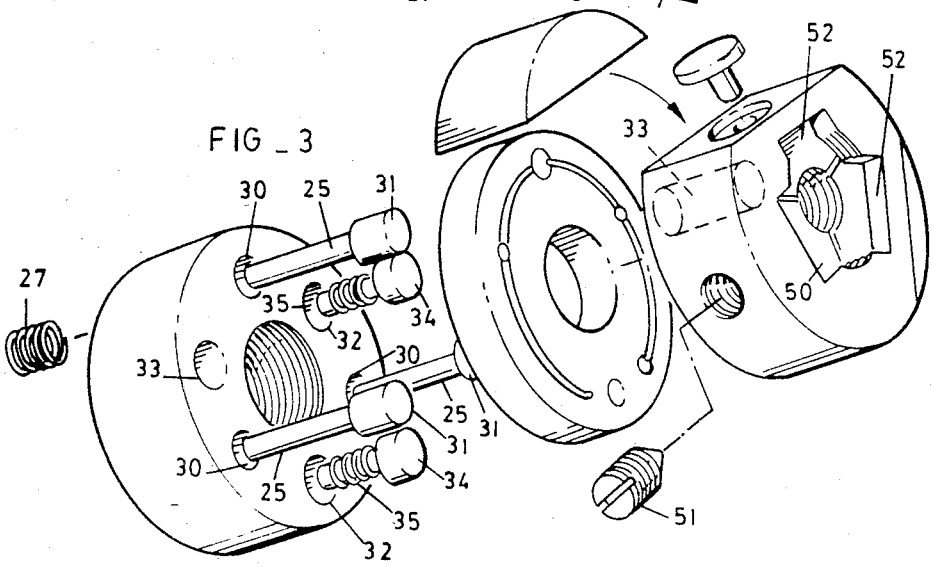
FIG. 3 is an exploded view of FIG. 2.
Figure 7:
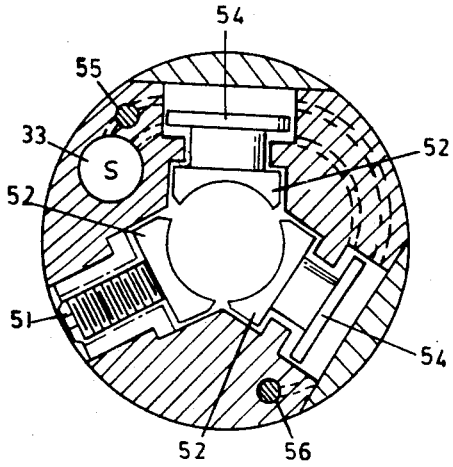
FIG. 7 is a section on the line 7—7 in FIG. 2.
Figure 4:
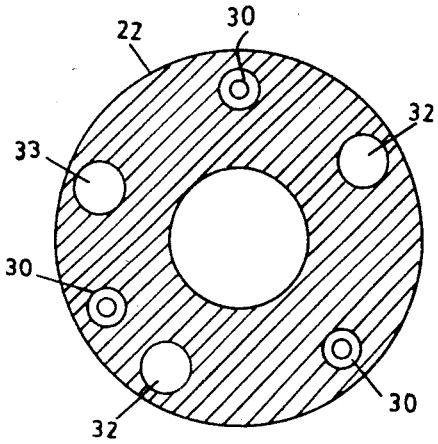
FIG. 4 is a section on the line 4—4 in FIG. 2 of part of the device.

FIG. 1 shows in general outline what the invention achieves. As shown there is a pump 10 with a pump rod 11 acted upon when the drill spindle is withdrawn to its home position. Through a oneway valve 12 the pump 10 charges an accumulator 13. There are a pair of clamping jaws 14 which are hydraulically actuated. As shown, by opening a valve 15 the jaws clamp together under the action of hydraulic fluid from the accumulator 13. To unclamp the jaws 14 a valve 16 is opened so that hydraulic fluid flows to the sump 17. The pump 10 draws fluid from the sump 17 through a oneway valve 18 and a pressure relief valve 19 protects the pump circuit.

Figure 6:
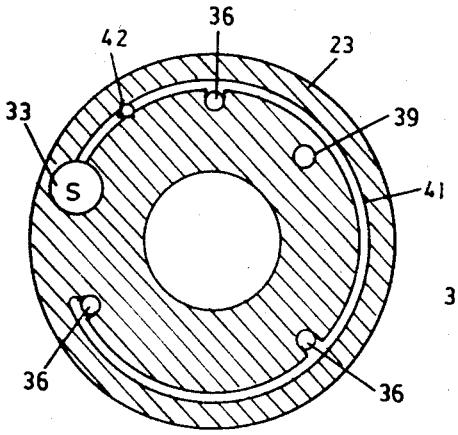
FIG. 6 is a section on the line 6—6 in FIG. 2.
Figure 5:
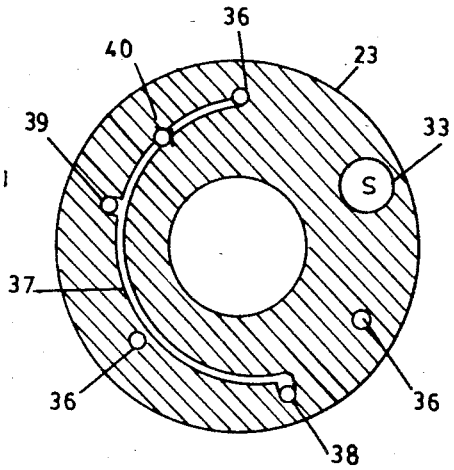
FIG. 5 is a section on the line 5—5 in FIG. 2.

This circuit may be translated into hardware by the device illustrated in FIGS. 2 to 7. In this case the front end of a drilling machine has been marked 20. The spindle 21 carries a chuck composed of three parts 22, 23 and 24. Projecting from the part 22 are three pump rods 25 carried by a yoke 26. Springs 27 act between the yoke 26 and the part 22 to bias the yoke 26 to the position shown. As the spindle 21 moves back and the part 22 moves closer to the front end 20, the yoke 26 pushes the rods 25 into the part 22 which is formed with three pump cylinders 30 which are bores through the part 22. The rods 25 carry pistons 31. There are also three blind bores in the part 22 and they have been marked 32 and 33. The bores 32 are accumulator cylinders and accumulator pistons 34 biased by springs 35 act in them. The bore 33 is part of the sump and continues into the part 23. The part 23 is formed with transfer grooves on its two faces as shown in FIGS. 5 and 6. Holes 36 in register with the pump cylinders 32 pass through the part 23.

On the face represented by FIG. 5 there is a transfer groove 37 leading from one hole 36 to a hole 38 through the part 23 and a cut-out 39 with the hole 38 and the cut-out 39 in register with the accumulator cylinders 32. There is also a oneway valve 40 which is shown diagramatically in FIG. 5.

On the face depicted in FIG. 6 there is a transfer groove 41 connecting the sump 33 via a oneway valve 42 to the holes 36. With the parts clamped together the pump rods will draw fluid from the sump 33 into the cylinders 30 under the action of the springs 27. If the yoke 26 is pressed against the part 22 fluid will be pumped through the one hole 36 along the groove 37 into the cylinders 32.

In the part 24 there are three clamping jaws of which one 50 is positioned by means of a dog screw 51 and the other two 52 are acted upon by the hydraulic circuit. Each jaw 52 is acted upon by a piston 54 the front of which is directly connected to the sump 33 and the rear of which is connected to the sump 33 via a valve 55 and to a continuation of the hole 39 via a valve 56 at the end of that continuation and controlling a passage to the rear of the pistons 54.

For the sake of simplicity seals have not been shown nor has the pressure relief valve between the groove 41 and the sump 33 been shown.

In use the accumulators 32 are charged each time that the yoke 26 abuts the front end 20. At that point both the valves 56 and 55 should be closed. After insertion of a drill stem, the valve 56 is opened so that the jaws 54 clamp the stem in the chuck under the constant ressure of fluid in the cylinders 32. At the end of a drilling stroke, the valve 56 is closed and the valve 55 is opened which allows fluid to drain from the rear of the pistons 54 to the sump 33. The drill stem is now unchucked and the spindle 21 may be rotated for the yoke 26 to compress another charge of hydraulic fluid in the cylinders 32. So the cycle is repeated.

I claim:

1. A chuck for use with a rotary drilling machine having a front end, and a feed screw connected to the front end and supported for forward and rearward reciprocating movement relative thereto, the chuck comprising:

a body adapted to be carried by the feed screw, forming a socket for receiving a drill rod, and including a plurality of movable jaws to clamp the drill rod in the socket; and a hydraulic circuit including (i) drive means to move the jaws, (ii) an accumulator for holding pressurized fluid, said accumulator being charged on rearward movement of the feed screw to a charging position, (iii) means for conducting pressurized fluid from the accumulator to the drive means to move the jaws and clamp the drill rod in the socket, (iv) a sump to hold a supply of fluid, (v) means to conduct pressurized fluid from the drive means to the sump to unclamp the drill rod from the jaws, (vi) a pumping cylinder, (vii) means to conduct fluid from the sump to the pumping cylinder, (viii) means to conduct fluid from the pumping cylinder to the accumulator, (ix) a plunger supported for reciprocating movement in the pumping cylinder, the plunger being pushed forward on rearward movement of the feed screw to the charging position to pressurize fluid in the pumping cylinder and to direct the pressurized fluid to the accumulator, and (x) a spring engaging the plunger and urging the plunger rearward to draw fluid into the pumping cylinder from the sump;

the body of the chuck further including a first cavity forming the accumulator, a second cavity forming the sump, a third cavity forming the pumping cylinder, first internal channel means forming the means to conduct fluid from the sump to the pumping cylinder, second internal channel means forming the means to conduct pressurized fluid from the cylinder to the accumulator, and third internal channel means forming the means for conducting pressurized fluid from the accumulator to the drive means.

2. A chuck according to claim 1 wherein:

the hydraulic circuit further includes second and third pumping cylinders;

the sump and the accumulator are common to each of the pumping cylinders; and each of said second and third pumping cylinder includes (i) a plunger supported for reciprocating movement in the cylinder, and being pushed forward on rearward movement of the feed screw to the charging position to pressurize fluid in the pumping cylinder and to direct the pressurized fluid to the accumulator, and (ii) a spring engaging the plunger of the cylinder and urging the plunger thereof rearward to draw fluid into the cylinder from the sump.

3. A chuck according to claim 2 wherein the body further includes:

another jaw to further engage the drill rod in the socket; and means to hold said other jaw stationary in the socket.

4. A chuck according to claim 1 wherein:

the body has a cylindrical shape;

each of the first, second and third cavities comprises an axial bore in the body;

the first internal channel means includes a first annular transfer channel extending between the sump and the pumping cylinder;

the second internal channel means includes a second annular transfer channel extending between the pumping cylinder and the accumulator; and the third internal channel means includes a third annular transfer channel extending between the accumulator and the drive means.

5. A chuck according to claim 4 wherein:

a first end of the third annular transfer channel is in fluid communication with the accumulator;

a second end of the third annular transfer channel is in fluid communication with the sump; and the hydraulic circuit further includes (i) a first valve located in the third annular channel to control the flow of pressurized fluid between the accumulator and the drive means, and (ii) a second valve located in the third annular transfer channel to control the flow of pressurized fluid between the drive means and the sump.

6. A rotary drilling machine comprising:

a front end;

a feed screw connected to the front end and supported for forward and rearward reciprocating movement relative thereto;

a chuck carried by the feed screw, forming a socket for receiving a drill rod, and including a plurality of movable jaws to clamp the drill rod in the socket; and a hydraulic circuit including (i) drive means to move the jaws, (ii) an accumulator comprising a first axial bore in the chuck for holding pressurized fluid, said accumulator being charged on rearward movement of the feed screw to a charging position, (iii) means for conducting pressurized fluid from the accumulator to the drive means to move the jaws and clamp the drill rod in the socket, (iv) a sump comprised of a second axial bore in the chuck, (v) first internal channel means to conduct pressurized fluid from the drive means to the sump to unclamp the drill rod from the jaws, (vi) a pumping cylinder comprised of a third axial bore in the chuck, (vii) second internal channel means to conduct fluid from the sump to the pumping cylinder, (viii) third internal channel means to conduct fluid from the pumping cylinder to the accumulator, (ix) a plunger supported for reciprocating movement in the pumping cylinder and pushed forward on a rearward movement of the feed screw to the charging position to pressurize fluid in the pumping cylinder and to direct said pressurized fluid to the accumulator, and (x) a spring engaging the plunger and urging the plunger rearward to draw fluid into the pumping cylinder from the sump.

7. A rotary drilling machine according to claim 6 wherein:

the first internal channel means includes a first annular transfer channel extending between the sump and the pumping cylinder;

the second internal channel means includes a second annular transfer channel extending between the pumping cylinder and the accumulator;

the third internal channel means includes a third annular transfer channel extending between the accumulator and the drive means; and the hydraulic circuit further includes a first one way valve located in the first annular transfer channel to control the direction of the flow of fluid between the sump and the pumping cylinder, and a second one way valve located in the second annular transfer channel to control the direction of the flow of fluid between the pumping cylinder and the accumulator.

8. A rotary drilling machine according to claim 7 wherein:

a first end of the third annular transfer channel is connected to the accumulator;

a second end of the third annular transfer channel is connected to the sump; and the hydraulic circuit further includes (i) a third valve located in the third annular transfer channel to control the flow of the pressurized fluid between the accumulator and the drive means, and (ii) a fourth valve located in the third annular transfer channel to control the flow of pressurized fluid between the drive means and the sump.

* * * * *